US005448799A

United States Patent [19]

Stein, Jr.

[11] Patent Number: 5,448,799

[45] Date of Patent: Sep. 12, 1995

[54] PANEL HINGE

[75] Inventor: Chester W. Stein, Jr., Lakeport, Calif.

[73] Assignee: Work Right Products, Inc., Santa Rosa, Calif.

[21] Appl. No.: 312,311

[22] Filed: Sep. 26, 1994

[51] Int. Cl.[6] ..... E05D 1/00; E05D 1/06

[52] U.S. Cl. ..... 16/225; 16/DIG. 13; 4/609; 160/235

[58] Field of Search ..... 16/225, 224, 273, 268, 16/355, 390, 261, 229, 232, 250, 260, 262, 265, 271, 382, DIG. 13; 4/609, 607, 614, 557; 160/40, 186, 199, 206, 229.1, 235

[56] References Cited

U.S. PATENT DOCUMENTS

| | | | |
|---|---|---|---|
| 2,882,564 | 4/1959 | Couse et al. | 160/229.1 |
| 4,131,971 | 1/1979 | Saarloos | 16/225 |
| 4,384,376 | 5/1983 | Shrode . | |
| 4,484,411 | 11/1984 | Rystad . | |
| 4,491,990 | 1/1985 | Robinson et al. . | |
| 4,720,876 | 1/1988 | Tomei et al. . | |
| 4,736,785 | 4/1988 | Seuster | 160/229.1 |
| 4,828,132 | 5/1989 | Francis, Jr. et al. | 16/225 |
| 4,924,932 | 5/1990 | Esnault | 160/201 |
| 4,934,115 | 6/1990 | Nozaki | 160/235 |
| 4,953,261 | 9/1990 | Lyons . | |
| 5,063,638 | 11/1991 | Howard et al. . | |
| 5,097,543 | 3/1992 | Oille . | |
| 5,123,129 | 6/1992 | Lyons . | |
| 5,148,850 | 9/1992 | Urbanick | 16/225 |
| 5,265,309 | 11/1993 | Oille . | |
| 5,363,616 | 11/1994 | Hernandez | 160/199 |

*Primary Examiner*—Mark Rosenbaum
*Assistant Examiner*—Chuck Y. Mah
*Attorney, Agent, or Firm*—Malcolm B. Wittenberg

[57] ABSTRACT

A hinge assembly for pivotally joining two panels such as a shower door and its enclosure. A pair of continuous channel members are provided which are provided with an axially aligned rod and tubular channel for rotatably receiving the rod. A strip of flexible molding is journalled within one of the elongated members such that when the panel members are aligned to form a continuous plane, the flexible molding is positioned to substantially inhibit the passage of water through the hinge.

12 Claims, 2 Drawing Sheets

PANEL HINGE

TECHNICAL FIELD OF THE INVENTION

This invention relates to an improved hinge structure which can be employed to rotatably join two panel members such as a shower door and shower enclosure assembly. The hinge is configured in conjunction with a strip of flexible molding to substantially prevent the passage of water through the hinge even if, for example, the shower door is not fully closed.

BACKGROUND OF THE INVENTION

Doors for shower stalls and entry ways are frequently mounted using vertical hinges. It is quite apparent that in a shower enclosure facility, such hinges must present a somewhat leak-proof barrier as it is anticipated that, during normal usage, water will invade the hinge assembly at times as a result of the direct impact of a continuous stream of water from the shower head.

Various prior art structures such as those disclosed in U.S. Pat. No. 4,953,261 employ hinged multi-panel door designs with special waterproof hinges and seams to prevent water intrusion. However, such designs tend to be complex and they do not necessarily present a waterproof structure in the event that, during use, the shower door is not fully closed or if the shower door becomes somewhat misaligned from its supporting structure over time. In other words, most waterproof hinges have special watertight edge surfaces which mate when the door assembly is closed. These watertight surfaces include magnetically attractive sealing strips which seal and secure the door assembly when it is closed. Door panel deflector sections are also generally used and are usually constructed in the form of metal stripping which is angled inwardly to deflect water but, once again, these expedients generally only function properly when the shower door has been fully closed so that the door and related assembly form a single unitary plane.

It is thus an object of the present invention to provide a novel hinge assembly that is used for connecting the panels of a shower enclosure and door together.

It is a further object of the present invention to provide a hinge assembly which is not complex in design and yet advantageously can be employed in a shower environment while preventing water intrusion.

These objects will become more readily apparent when considering the following disclosure and appended drawings.

SUMMARY OF THE INVENTION

A hinge assembly for pivotally joining two panels. First and second axially elongated members, each having substantially constant crossections, are provided each having a pair of spaced apart sidewalls interconnected with a bight together forming a forwardly open channel for receiving either a panel member or hardware for connecting the hinge assembly to a suitable support.

The wall structure of the first of said elongated members is further provided with an elongated web. The elongated web terminates as an axially aligned rod, the rod having a substantially circular crossection.

The wall structure of the second elongated member is provided with an internal keyway which includes an axially aligned tubular channel for rotatably receiving the axially aligned rod extending from the first elongated member. The second elongated member is also provided with an offset extension from the wall structure including an axially aligned molding channel extending substantially the entire length of the second elongated member.

The strip of flexible molding is journalled within the molding channel which extends therefrom such that as the first and second axially aligned members are substantially aligned to form a unitary plane, the strip of flexible molding abuts the wall structure of the first elongated member. This substantially inhibits the passage of water to the internal keyway.

Finally, a gudgeon clip assembly is provided. The gudgeon clip assembly is retained by the internal keyway for maintaining axial alignment of the rod and tubular channel.

DETAILED DESCRIPTION OF THE INVENTION

Figure 2:
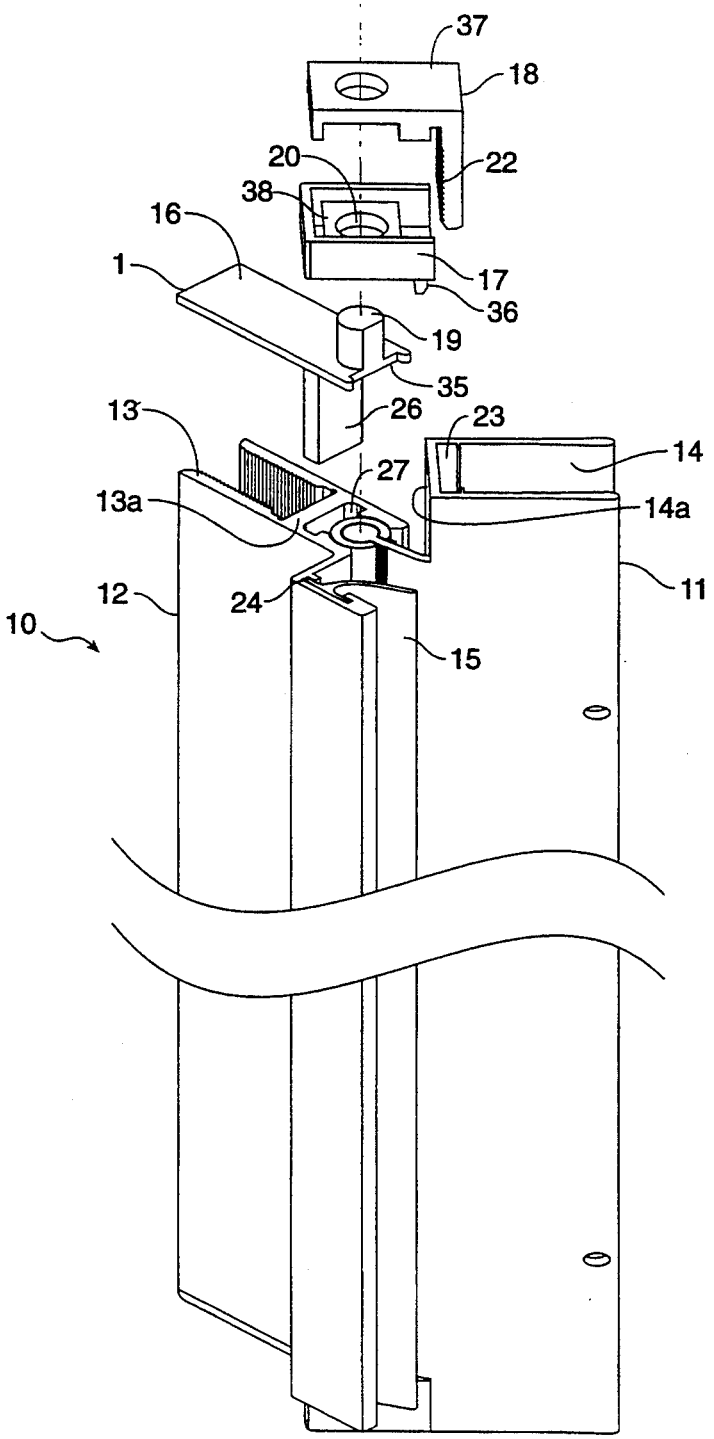
FIG. 2 is a prospective expanded view of the present invention in a partially opened configuration.

Turning first to FIG. 2, hinge assembly 10 is shown. Specifically, first and second axially elongated members 11 and 12 are depicted in perspective. Each elongated member is shown to have a substantially constant crossection therealong. First axially elongated member 11 is provided with a pair of spaced apart walls 14 interconnected by a bight 14A forming a forwardly open channel. Similarly, second axially elongated member 12 is shown to have a substantially constant crossection having a pair of spaced apart walls 13 interconnected by a bight 13A which together form a forwardly open channel. The forwardly open channels of first and second axially elongated members are created for receiving either a panel member, such as a glass shower door, or are used for supportively connecting the hinge assembly to a suitable wall support.

Figure 1A:
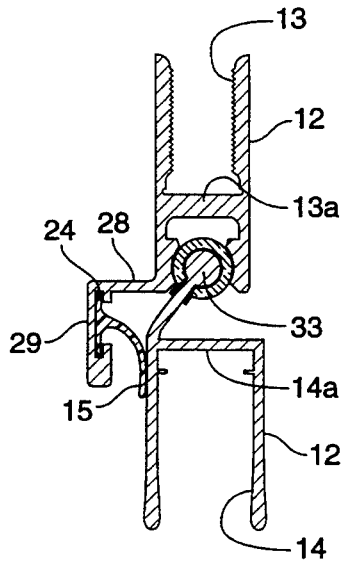
FIGS. 1A and 1B are crossectional views of the hinge assembly of the present invention in opened and closed positions.
Figure 1B:
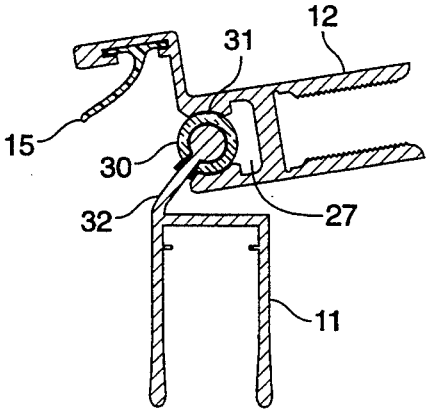

The wall structure of first elongated member 11 is further provided with elongated web 32 (FIG. 1B). Elongated web 32 is terminated with axially aligned rod 33 which, as a preferred embodiment, can be encased within sleeve 30 in order to facilitate rotation of the first and second axially elongated members. Sleeve 30 can be composed of any well known suitable plastic such as polypropylene or Teflon ®.

Second elongated member 12 is provided with internal keyway 27 which includes axially aligned tubular channel 31 for rotatably receiving axially aligned rod 33. Elongated member 12 is further provided with an offset extension 28/29 which is shown in FIG. 1 as a 90° leg which includes axially aligned molding channel 24 which extends substantially the entire length of second elongated member 12.

A strip of flexible molding 15 is journalled within molding channel 24 and extends therefrom as best depicted in FIGS. 1A and 1B. The strip of flexible molding abuts the wall structure of first elongated member 11, thus substantially inhibiting the passage of water to internal keyway 27 not only when the hinge assembly is closed, creating a single plane between elongated members 11 and 12, but also, in light of the resilient flexible nature of flexible molding 15 and its positioning within molding channel 24, is capable of substantially inhibiting the passage of water to internal keyway 27 even when axially elongated members 11 and 12 are rotated along tubular channel 31 by as much as ±10° from a unitary plane.

As best seen by again referring to FIG. 2, gudgeon clip 1 is provided with leg portion 26 for fitting within internal keyway 27 of second elongated member 12. Gudgeon clip 1 is further provided with shelf 16 which, when in place, extends over forwardly open channel of second axially elongated member 12, as well as over rod-shaped extension 33. As such, gudgeon 1 is intended to be inserted within internal keyway 27 after second axially elongated member 12 has been securely connected to a suitable panel member such as a glass shower door, an edge of which is caused to pass within the forwardly extending channel of axially elongated member 12 and be captured thereby.

Gudgeon 1 is further provided with rod-shaped extension 19 which is caused to emanate from shelf 16 as shown in FIG. 2. A second gudgeon clip 18 is shown in FIG. 2 having leg portion 22 for fitting within internal keyway 23 of first axially elongated member 11. Second gudgeon clip 18 is shown to have its own shelf portion 37 which, when in place, extends over rod-shaped extension 19 which fits within opening 21 of second gudgeon 18 for receiving and rotatably engaging rod-shaped extension 19.

It is also contemplated that the present hinge assembly further comprises clip means 17 for insertion between first and second gudgeon clip assemblies 1 and 18. Clip means 17 is provided with a shelf 38 extending over rod-shaped extension 19 which in turn passes through opening 20 for rotatably engaging rod-shaped extension 19. Ideally, clip means 17 is provided with downwardly projecting leg 36 which engages first gudgeon clip 1 for creating a bias for aligning first and second axially elongated members 11 and 12 into a single plane. As noted from the above discussion, it is quite evident that the present invention is comprised of rather simplistic, extruded components which are easy to fabricate and to assemble on site. Yet, the present hinge effectively prevents water intrusion through the internal keyway assembly not only when the hinge is completely closed, thus forming a unitary plane between axially elongated member 11 and 12, but also when misalignment occurs up to approximately ±10° between hinge members.

Although this invention has been described above in considerable detail in the foregoing specification, it is not intended that the invention be limited by such detail, except as is necessary by the language of the following claims.

What is claimed is:

1. A hinge assembly for pivotally joining two panels comprising:

first and second axially elongated members each having substantially constant cross-sections therealong and each having a pair of spaced apart side walls interconnected by a bight together forming a forwardly open channel for receiving either a panel member or hardware for supportively connecting the hinge assembly to a suitable support;

the wall structure of said first of said elongated members further being provided with an elongated web terminating in an axially aligned rod, said rod having a substantially circular cross-section;

the wall structure of said second of said elongated members being provided with (1) an internal keyway which includes an axially aligned tubular channel for rotatably receiving said axially aligned rod extending from said first of said elongated members and (2) an off-set extension from said wall structure including an axially aligned molding channel extending substantially the entire length of said second of said elongated members;

a strip of flexible molding journalled within said molding channel and extending therefrom such that as said first and second axially elongated members are substantially aligned to form a unitary plane, said strip of flexible molding abuts the wall structure of said first elongated member thus substantially inhibiting the passage of water to said internal keyway; and a gudgeon clip assembly retained by said internal keyway for maintaining axial alignment of said rod and tubular channel.

2. The hinge assembly of claim 1 wherein said first elongated member is provided with an internal keyway aligned along the axial length of said first elongated member.

3. The hinge assembly of claim 2 wherein said gudgeon clip assembly comprises a first gudgeon clip having a leg portion for fitting within the internal keyway of said second elongated member, a shelf portion which extends over said forwardly open channel of said second elongated member and rod-shaped extension emanated from said shelf portion and second gudgeon clip having a leg portion for fitting with the internal keyway of said first elongated member, a shelf portion extending over said rod-shaped extension and an opening in said second gudgeon shelf portion for receiving and rotatably engaging said rod-shaped extension.

4. The hinge assembly of claim 3 further comprising clip means for insertion between said first and second gudgeon clip assemblies, said clip means having a shelf portion extending over said rod-shaped extension and having an opening therein for receiving and rotatably engaging said rod-shaped extension, said clip means being sized and positioned to remain aligned with said second gudgeon clip and having a downwardly projecting leg which engages said first gudgeon clip creating a bias for alignment of said first and second axially elongated members into a single plane.

5. The hinge assembly of claim 1 wherein said strip of flexible molding substantially inhibits the passage of water to said internal keyway even when said axially elongated members are rotated along said tubular channel by as much as ±10° from a unitary plane.

6. The hinge assembly of claim 1 wherein said rod is substantially encased within a sleeve to facilitate rotation of said first and second axially elongated members.

7. A hinge assembly for pivotally joining a shower door to a shower enclosure comprising:

first and second axially elongated members each having substantially constant cross-sections therealong and each having a pair of spaced apart side walls interconnected by a bight together forming a forwardly open channel for receiving either a panel member or hardware for supportively connecting the hinge assembly to a suitable support;

the wall structure of said first of said elongated members further being provided with an elongated web terminating in an axially aligned rod, said rod having a substantially circular cross-section;

the wall structure of said second of said elongated members being provided with (1) an internal keyway which includes an axially aligned tubular channel for rotatably receiving said axially aligned rod extending from said first of said elongated members and (2) an off-set extension from said wall structure including an axially aligned molding channel extending substantially the entire length of said second of said elongated members;

a strip of flexible molding journalled within said molding channel and extending therefrom such that as said first and second axially elongated members are substantially aligned to form a unitary plane, said strip of flexible molding abuts the wall structure of said first elongated member thus substantially inhibiting the passage of water to said internal keyway; and a gudgeon clip assembly retained by said internal keyway for maintaining axial alignment of said rod and tubular channel.

8. The hinge assembly of claim 7 wherein said first elongated member is provided with an internal keyway aligned along the axial length of said first elongated member.

9. The hinge assembly of claim 8 wherein said gudgeon clip assembly comprises a first gudgeon clip having a leg portion for fitting within the internal keyway of said second elongated member, a shelf portion which extends over said forwardly open channel of said second elongated member and rod-shaped extension emanated from said shelf portion and second gudgeon clip having a leg portion for fitting with the internal keyway of said first elongated member, a shelf portion extending over said rod-shaped extension and an opening in said second gudgeon shelf portion for receiving and rotatably engaging said rod-shaped extension.

10. The hinge assembly of claim 9 further comprising clip means for insertion between said first and second gudgeon clip assemblies, said clip means having a shelf portion extending over said rod-shaped extension and having an opening therein for receiving and rotatably engaging said rod-shaped extension, said clip means being sized and positioned to remain aligned with said second gudgeon clip and having a downwardly projecting leg which engages said first gudgeon clip creating a bias for alignment of said first and second axially elongated members into a single plane.

11. The hinge assembly of claim 7 wherein said strip of flexible molding substantially inhibits the passage of water to said internal keyway even when said axially elongated members are rotated along said tubular channel by as much as $\pm 10°$ from a unitary plane.

12. The hinge assembly of claim 7 wherein said rod is substantially encased within a sleeve to facilitate rotation of said first and second axially elongated members.

* * * * *